US006979096B2

(12) United States Patent
Ortega

(10) Patent No.: US 6,979,096 B2
(45) Date of Patent: Dec. 27, 2005

(54) LED LIGHTING FOR PROPORTION BLENDING SYSTEM

(75) Inventor: Victor J. Ortega, Kennesaw, GA (US)

(73) Assignee: The Coca-Cola Company, Atlanta, GA (US)

( * ) Notice: Subject to any disclaimer, the term of this patent is extended or adjusted under 35 U.S.C. 154(b) by 31 days.

(21) Appl. No.: 10/386,404

(22) Filed: Mar. 11, 2003

(65) Prior Publication Data

US 2004/0179350 A1 Sep. 16, 2004

(51) Int. Cl.[7] ..... F21V 33/00

(52) U.S. Cl. ..... 362/101; 362/92; 362/96; 362/800

(58) Field of Search ..... 362/154, 155, 362/101, 96, 92, 800, 253, 234, 89, 802, 240, 236, 238, 231, 276; 221/124, 181

(56) References Cited

U.S. PATENT DOCUMENTS

| | | | |
|---|---|---|---|
| 3,471,210 A | 10/1969 | Barroero | 312/329 |
| 3,831,807 A | 8/1974 | Deaton et al. | 221/85 |
| 4,146,883 A | 3/1979 | Appeldorn et al. | 340/378 |
| 4,240,563 A | 12/1980 | Lennartson | 221/75 |
| 4,284,207 A | 8/1981 | Christian | 221/90 |
| 4,318,485 A | 3/1982 | Clement | 211/49 D |
| 4,646,528 A | 3/1987 | Marcade et al. | 62/127 |

(Continued)

FOREIGN PATENT DOCUMENTS

| | | |
|---|---|---|
| DE | 297 04 335 U1 | 5/1997 |
| DE | 298 03 105 U1 | 2/1998 |
| EP | 0 903 549 A2 | 9/1998 |
| JP | 2001-082869 | 3/2001 |
| WO | WO 91/07641 | 5/1991 |
| WO | WO 01/00065 A1 | 1/2001 |
| WO | WO 2004/030438 A2 | 4/2004 |

OTHER PUBLICATIONS

Title: "Chromacore® under the hood", Color Kinetics, Mar. 6, 2003, webpages 1 & 2.

Title: "Leading benefits of the PBS™", Vita–Mix Foodservice, Mar. 4, 2003, webpage 1.

Title: "Blended, Not Stirred—The Portion Blending System® From Vita–Mix Gives Operators Consistent Results", Mar. 4, 2003, VitaNews, webpages 1 & 2.

Title: "Introducing the New Portion Blending System™ From Vita–Mix", Mar. 4, 2003, webpages 1 and 2.

*Primary Examiner*—Sandra O'Shea
*Assistant Examiner*—Hargobind S. Sawhney
(74) *Attorney, Agent, or Firm*—Sutherland Asbill & Brennan LLP

(57) ABSTRACT

The ice dispenser includes an ice hopper for holding the ice and a lighting system positioned about the ice hopper for illuminating the ice. The lighting system may include a number of light emitting diodes.

19 Claims, 2 Drawing Sheets

U.S. PATENT DOCUMENTS 4,719,765 A * 1/1988 Hooper et al. ..... 62/264
4,851,662 A 7/1989 Ott et al. ..... 250/214
4,928,853 A 5/1990 Isham et al. ..... 222/108
4,977,754 A 12/1990 Upton et al. ..... 62/248
5,056,334 A * 10/1991 Hooper et al. ..... 62/320
5,165,255 A * 11/1992 Alvarez et al. ..... 62/344
5,284,022 A 2/1994 Chung ..... 62/6
5,392,953 A 2/1995 Maldanis et al. ..... 221/97
5,445,287 A 8/1995 Center et al. ..... 221/1
D367,864 S 3/1996 Lacewell ..... D15/85
5,520,450 A 5/1996 Colson, Jr. et al. ..... 312/215
5,567,026 A 10/1996 Lacewell ..... 312/135
5,575,459 A 11/1996 Anderson ..... 362/240
D377,800 S 2/1997 Branz et al. ..... D15/85
D383,796 S 9/1997 Rinicella et al. ..... D20/42
5,706,957 A 1/1998 Hardy ..... 211/59.2
5,772,072 A 6/1998 Prescott et al. ..... 221/121
D395,968 S 7/1998 Shappell ..... D6/509
5,820,246 A 10/1998 Helstern ..... 362/84
5,823,390 A 10/1998 Muderlak et al. ..... 222/38
D402,138 S 12/1998 Trulaske, Sr. ..... D6/470
5,967,367 A 10/1999 Orsborn ..... 222/30
D422,448 S 4/2000 Kindig et al. ..... D7/378
6,079,216 A 6/2000 De Marsillac Plunkett et al. ..... 62/56
6,131,399 A 10/2000 Hall ..... 62/127
6,194,013 B1 2/2001 Kolar et al. ..... 426/231
6,237,811 B1 * 5/2001 Ford ..... 222/129.1
6,342,260 B2 * 1/2002 Kolar et al. ..... 426/231
6,354,098 B1 * 3/2002 Bardin et al. ..... 62/250
6,550,269 B2 * 4/2003 Rudick ..... 62/440
6,725,675 B2 * 4/2004 Kampert et al. ..... 62/71
2002/0051357 A1 5/2002 Truttmann-Battig ..... 362/92
2004/0012959 A1 * 1/2004 Robertson et al. ..... 362/247

* cited by examiner

LED LIGHTING FOR PROPORTION BLENDING SYSTEM

TECHNICAL FIELD

The present invention relates generally to an ice dispensing apparatus and more particularly relates to a crushed ice dispensing apparatus with light emitting diode ("LED") lighting sources.

BACKGROUND OF THE INVENTION

The design and the construction of a dispensing apparatus may focus on the sometimes conflicting goals of (1) how effectively the apparatus markets the products therein and/or the use of the apparatus itself and (2) how efficient the apparatus may be in terms of energy consumption. By product marketing, we mean that the dispensing apparatus and/or the products therein should be visually appealing so as to catch the eye of the consumer. The apparatus and/or the products therein preferably can be easily seen and identified. By energy efficiency, we mean that the energy usage of the apparatus should be reasonable with respect to the desired cooling load and any other desired functions of the apparatus, such as product marketing.

These conflicting goals, however, may not be easily reconciled. For example, the energy costs involved in effectively lighting the apparatus at all times may be extensive. Conversely, insufficient lighting or the inability of the apparatus to catch and keep the eye of the consumer may affect desired sales levels.

What is desired, therefore, is a dispensing apparatus that adequately illuminates and promotes the apparatus and/or the products therein while being reasonable in terms of energy usage. One solution in the context of refrigerators, coolers, or other types of devices for holding a number of products have included the use of light emitting diodes {"LED's") and directional LED's to illuminate the individual products therein. Examples include co-owned U.S. Pat. No. 6,354,098 entitled "Cooler" and U.S. patent application Ser. No. 10/047,354, now U.S. Pat. No. 6,550,209, entitled "Dispensing Apparatus with Directional LED Lighting", incorporated herein by reference.

More particularly, what is further desired is an ice dispensing apparatus that adequately illuminates the ice therein and promotes the use of the apparatus while being reasonable in terms of energy usage. These competing goals should be accomplished in an apparatus that is reasonable in terms of the cost of manufacture and the cost of usage.

SUMMARY OF THE INVENTION

The present invention thus may provide an ice dispenser. The ice dispenser may include an ice hopper for holding the ice and a lighting system positioned about the ice hopper for illuminating the ice. The lighting system may include a number of light emitting diodes.

The ice hopper may include a transparent material. The lighting system may be positioned within the ice hopper. The ice dispenser further may include a number of lighting systems.

The ice dispenser may include an electrical motor. The motor may be a multiple speed motor. The motor may include a blender motor. The lighting system may have a sensor in communication with the electrical motor. The sensor may be a Hall effect sensor. The lighting system may include a controller in communication with the sensor and the light emitting diodes. The controller may vary the intensity of the light emitting diodes based upon the speed of the electrical motor as sensed by the sensor. The lighting system may include a MOSFET switch positioned between the controller and the light emitting diodes. The controller may operate the light emitting diodes via pulse width modulation.

The lighting system may include a tube to position the light emitting diodes therein. The light emitting diodes may include white light emitting diodes.

A method of the present invention may provide for illuminating a product bin. The product bin may have an electric motor positioned adjacent thereto for modifying the product in the product bin. The method may include positioning a number of light emitting diodes about the product bin, sensing the speed of the electric motor, and varying the intensity of the light emitting diodes based upon the speed of the electric motor.

A further embodiment of the present invention may provide a lighting system for a product bin. The product bin may have an electrical motor positioned adjacent thereto for modifying the product in the product bin. The lighting system may include a number of light emitting diodes positioned about the product bin, a sensor positioned in communication with the electrical motor, and a controller in communication with the sensor and the light emitting diodes so as to vary the intensity of the light emitting diodes based upon the speed of the electrical motor.

The sensor may be a Hall effect sensor. The lighting system may include a MOSFET switch positioned between the controller and the light emitting diodes. The controller may operate the light emitting diodes via pulse width modulation.

Other features of the present invention will become apparent upon review of the following detailed description of the preferred embodiments of the invention, when taken in conjunction with the drawings and the appended claims.

DETAILED DESCRIPTION

Figure 1:
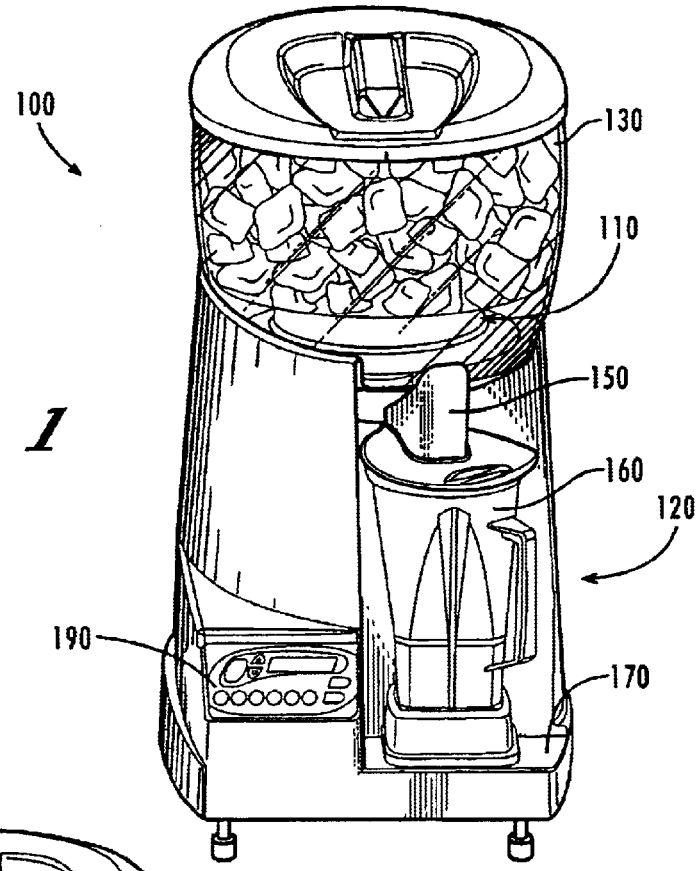
FIG. 1 is a perspective view of a proportion blending device.

Referring now in more detail to the drawings, in which like numerals refer to like elements throughout the several views, FIG. 1 shows a proportion blending device 100 that may be used with the present invention. The proportion blending device 100 includes both an ice shaver section 110 and a blending section 120. The combination of the ice shaver section 110 and the blending section 120 allows the proportion blending device 100 to produce consistently proportioned and blended frozen beverages. The proportion blending device 100 thus is well suited for fast paced bar and restaurant operations.

The Vita-Mix Corporation of Cleveland, Ohio sells a proportion blending device 100 that may be used with the present invention under the designation "Vita-Mix Proportion Blending System". A description of the proportion blending system from The Vita-Mix Corporation can be found at http://www.vitamix.com/foodservice/index.html, incorporated herein by reference.

The ice shaver section 110 of the proportion blending device 100 may include an ice hopper 130. The ice hopper 130 may be made out of polycarbonate or similar types of materials. The ice hopper 130 may hold about five (5) gallons (about nineteen (19) liters) of ice. The ice hopper 130 preferably is transparent or at least translucent such that the user or others near the proportion blending device 100 as a whole can see the ice therein.

The ice shaver section 110 also may have an ice shaver 140 positioned in communication with the ice hopper 130. The ice shaver 140 may be about a one-quarter horsepower permanent magnet motor or a similar type of device. The ice shaver 140 shaves the ice cubes in the ice hopper 130 to the desired consistency.

The ice shaver section 110 also may include an ice door 150. The ice door 150 may be in communication with an ice shaver 140. The ice door 150 may be a standard passageway between the ice shaver 140 and the blending section 120. The ice door 150 preferably may be transparent or at least translucent such that the user can see the shaved ice as it passes at least part of the way therethrough.

The blender section 120 may include a container 160 positioned beneath the ice door 150. The container 160 may be a standard blender container with one or more agitators positioned therein so as to blend the beverage therein in a conventional manner. The container 160 preferably may be transparent or at least translucent such that the user can see the beverage as it is blended therein.

The blending section 120 may include a base 170 such that the container 160 can fit therein. The blending section 120 also may include a blender motor 180. The blender motor 180 may drive a number of agitators in the container 160 via the base 170 in a conventional manner. The blender motor 180 may be about a two (2) horsepower motor or a similar device. The blender motor 180 preferably is a variable speed motor.

The proportion blending device 100 also may include a control panel 190. The control panel 190 may include a standard microcontroller or a similar type of control device. The control panel 190 may allow the user to select the number of beverages to be produced and the nature of the beverages. For example, frozen fruit drinks, ice cream drinks, and similar types of beverages may be produced such that the control panel 190 informs the blender motor 190 of the appropriate speed and time of operation. The control panel 190 also may include a timer, a counter for machine usage, a low ice indicator, and similar types of controls. The proportion blending device 100 also may include a drain therein.

In use, the user may place the drink mix, or other matter such as fruit or ice cream, within the container 160 and indicate the nature of the beverage on the control panel 190. The ice shaver 140 then shaves an appropriate amount of ice from the ice hopper 130 such that the ice falls through the ice door 150 and into the container 160. The blender motor 180 of the blending section 120 is then activated at the appropriate speed and for the appropriate length of time so as to blend the beverage to the desired consistency.

The present invention concerns the use of a lighting system 200 to be used in connection with the proportion blending device 100, a similar type of ice or liquid container, or other type of structure. Specifically, the lighting system 200 includes the use of a number of light emitting diodes ("LED's) 210 positioned within the ice hopper 130 of the proportion blending device 100. The LED's 210 may serve to illuminate the ice within the ice hopper 130 so as to call attention to the ice and to the proportion blending device 100 itself.

Figure 2:
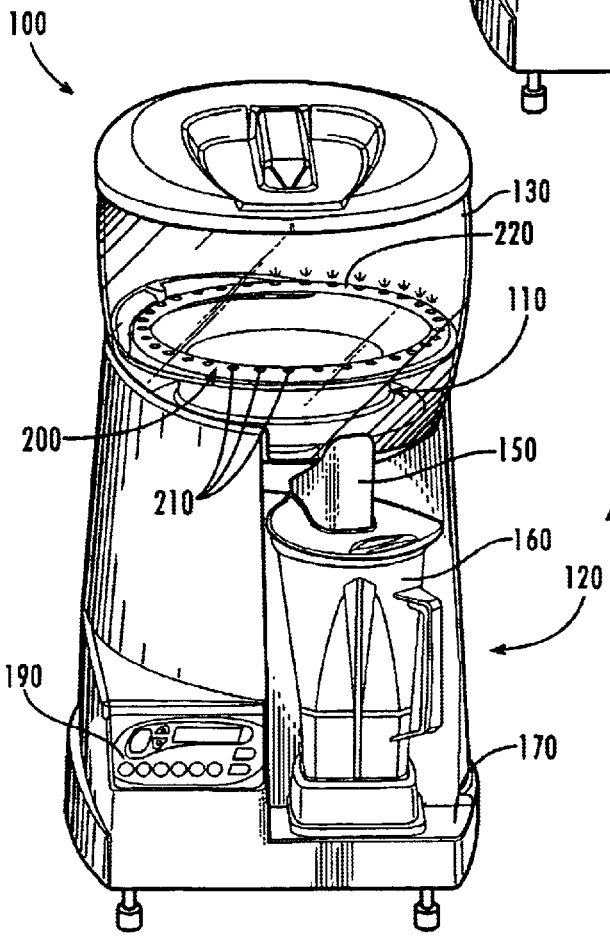
FIG. 2 is a perspective view of the proportion blending device of FIG. 1 with the lighting system of the present invention.
Figure 3:
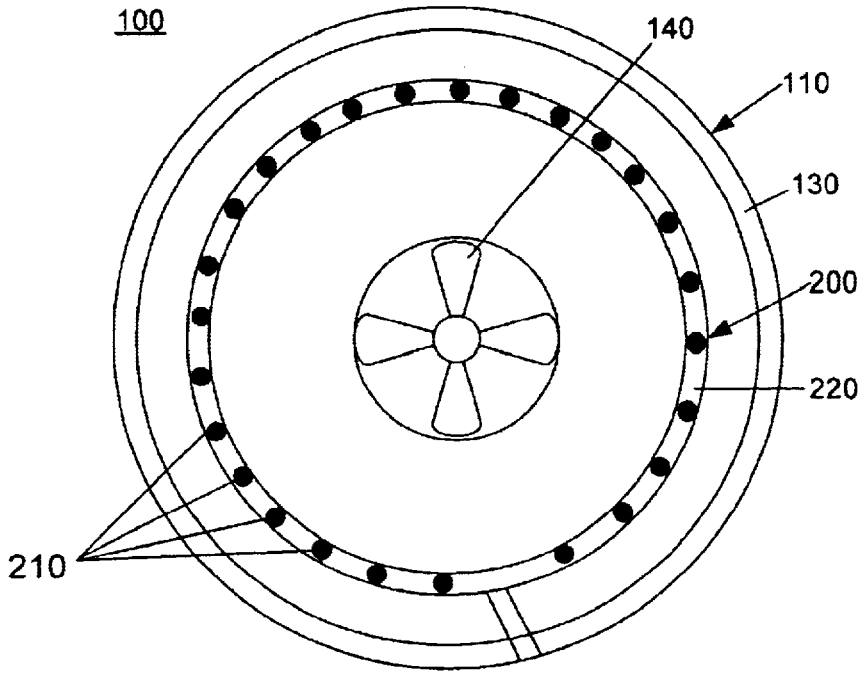
FIG. 3 is a top plan view of the ice bucket with the LED light rope therein as used in the proportion blending system of FIG. 1

In this example, the LED's 210 may be arranged within a tube 220. The tube 220 preferably may be made out of a thermoplastic or a similar material. The tube 220 preferably is clear, transparent, or translucent such that the light from the LED's 210 is largely unobstructed. The tube 220 may have a diameter of about one-half (0.5) to about three-quarters (0.75) inches (about 1.27 to about 1.9 centimeters), although any diameter may be used. The tube 220 may extend around the diameter of the ice hopper 130. As is shown in FIGS. 2 and 3, the tube 220 may extend around the bottom, the top, and/or the middle of the ice hopper 130 in any pattern. More than one (1) tube 220 may be used in a hopper 130. The individual LED's 210 preferably are sealed within the tube 220 so as to avoid contact with the ice, the liquid, or other substance within the ice hopper 130.

Any number of the individual LED's 210 may be used herein. In this embodiment, twenty-two (22) high intensity LED's are wired in parallel. The LED's 210 may be connected by a 26 AGW (silver tungsten alloy) wire or a similar type of wire. The LED's 210 may be about a 51.0 Ohm resistor. The LED's 210 preferably may be white in color, but any desired color may be used. The LED's 210 may provide various colors, such as blue, red, and green that may be used separately or together. The LED's 210 described herein also may be placed outside of the hopper 130. The LED's 210 described herein also may be used in combination with conventional lighting sources.

The LED's 210 may have a significantly longer lifetime than fluorescent lighting or other types of conventional lighting sources. For example, it may be expected for the LED's 210 to last as long as the proportion blending device 100 itself. As such, there is generally no replacement costs involved in the long term use of the LED's 210. Further, the LED's 210 generally require very little maintenance, if any.

Not only may the LED's 210 have a significant lifetime, the LED's 210 generally require much less energy to operate than conventional lighting sources. The LED's 210 also produce very little heat. As such, the overall efficiency of the proportion blending device 100 may not be affected. Further, the LED's 210 will not melt the ice within the ice hopper 130.

Figure 4:
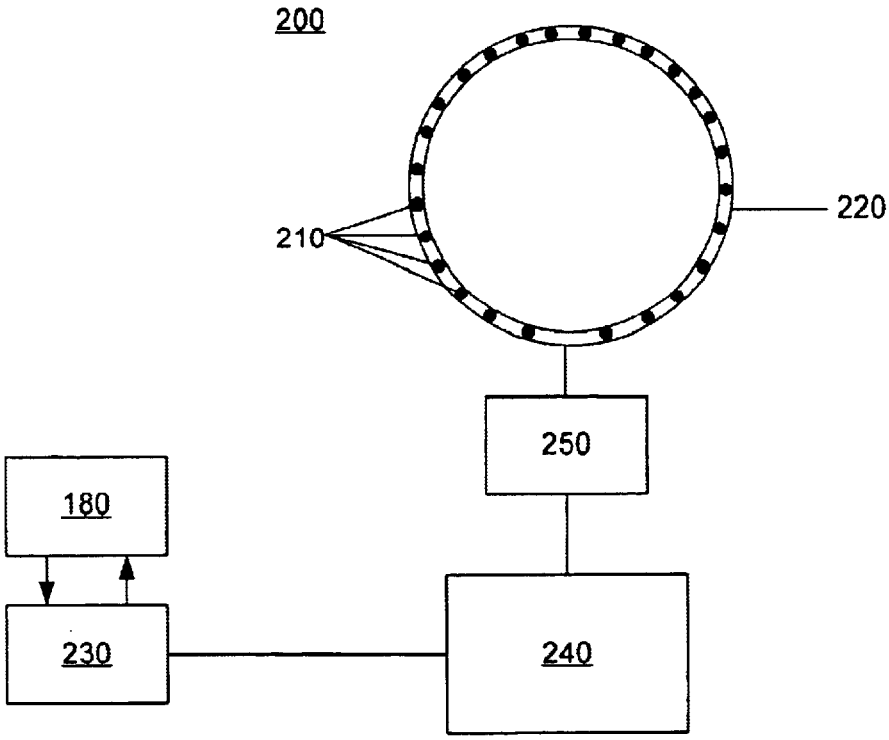
FIG. 4 is a schematic view of the lighting system for use with the proportion blending device of FIG. 1 and otherwise.

FIG. 4 is a schematic view of one embodiment of the lighting system 200 as a whole. The lighting system 200 may include a Hall effect sensor 230 positioned about the blender motor 180. The Hall effect sensor 230 may be of conventional design. The Hall effect sensor 230 senses the speed of the blender motor 180 based upon the magnetic field generated therein, i.e., the Hall effect sensor 230 can determine when the blender motor 180 is on and the speed of the motor 180. Other types of sensors also may be used. Likewise, other motor or other system parameters also may be sensed.

The output of the Hall effect sensor 230 may be inputted to a microcontroller 240. The microcontroller 240 may be a PIC16F876 microcontroller sold by Microchip Corporation of Chandler, Ariz. or a similar type of device. The microcontroller 240 may be positioned about a printed circuit board (PCB) with a transformer positioned thereon. The PCB and the transformer may be conventional devices.

Output from the microcontroller 240 may be in communication with a MOSFET switch (Metal Oxide Semiconductor Field Effect Transistor) 250 which is in turn in communication with the LED's 210. The MOSFET switch 250 closes the circuit between the microcontroller 240 and the LED's 210 when the blender motor 180 is activated. The microcontroller 240 rapidly switches the channels of the LED's in Pulse Width Modulation to control the intensity of the light.

Any other method of controlling the LED's 210 also may be used. For example, the LED's 210 could be illuminated whenever the proportion blending device 100 is on regardless of whether the blender motor 180 is activated. Any other illumination pattern also may be used.

In use, the Hall effect sensor 230 determines the speed of the blender motor 180. The speed is outputted to the microcontroller 240. When the motor 180 is on, the MOSFET switch 250 opens the circuit with the LED's 210. The microcontroller 240 then varies the intensity of the light produced by the LED's via Pulse Width Modulation according to the speed of the motor 180 as determined by the sensor 230. The result is that the LED's 210 are illuminated with greater intensity as the speed of the blender motor 180 increases.

The LED's 210 thus serve to illuminate the ice within the ice hopper 130 and also to call attention to the proportion blending device 100 as a whole. Further, by sensing the speed of the blending motor 180, the lighting system 200 particularly draws attention to the device 100 when the device 100 is in use. The illumination of the ice may make a cold or a frozen beverage desirable to the consumer.

Although the present invention has been described in terms of the proportion blending device 100, the lighting system 200 described herein also may be used with any other device that holds and displays ice, liquid, or other types of materials or products. As described above, the lighting system 200 is particularly useful with cold items in that the LED's 210 do not produce heat.

It should be apparent that the foregoing relates only to the preferred embodiments of the present invention and that numerous changes and modifications may be made herein without departing from the spirit and scope of the invention as defined by the following claims and the equivalents thereof.

I claim:

1. An ice dispenser, comprising:

an ice hopper for holding the ice;

a lighting system positioned about said ice hopper for illuminating the ice;

said lighting system comprising a plurality of light emitting diodes; and an electric motor such that the intensity of said plurality of light-emitting diodes varies with the speed of said electric motor.

2. The ice dispenser of claim 1, wherein said ice hopper comprises a transparent material.

3. The ice dispenser of claim 1, wherein said lighting system is positioned within said ice hopper.

4. The ice dispenser of claim 1, further comprising a plurality of lighting systems.

5. The ice dispenser of claim 1, wherein said motor comprises a multiple speed motor.

6. The ice dispenser of claim 1, wherein said motor comprises a blender motor.

7. The ice dispenser of claim 1, wherein said lighting system comprises a sensor in communication with said electrical motor.

8. The ice dispenser of claim 7, wherein said sensor comprises a Hall effect sensor.

9. The ice dispenser of claim 7, wherein said lighting system comprises a controller in communication with said sensor and said plurality of light emitting diodes.

10. The ice dispenser of claim 9, wherein said controller varies the intensity of said plurality of light emitting diodes based upon the speed of said electrical motor as sensed by said sensor.

11. The ice dispenser of claim 9, wherein said lighting system comprises a MOSFET switch positioned between said controller and said plurality of light emitting diodes.

12. The lighting system of claim 9, wherein said controller operates said plurality of light emitting diodes via pulse width modulation.

13. The ice dispenser of claim 1, wherein said lighting system comprises a tube to position said plurality of light emitting diodes therein.

14. The ice dispenser of claim 1, wherein said plurality of light emitting diodes comprises white light emitting diodes.

15. A method for illuminating a product bin, the product bin having an electric motor positioned adjacent thereto for modifying the product in the product bin, comprising:

positioning a plurality of light emitting diodes about the product bin;

sensing the speed of the electric motor; and varying the intensity of the light emitting diodes based upon the speed of the electric motor.

16. A lighting system for a product bin with an electrical motor positioned adjacent thereto for modifying the product in the product bin, comprising:

a plurality of light emitting diodes positioned about said product bin;

a sensor positioned in communication with said electrical motor; and a controller in communication with said sensor and said plurality of light emitting diodes so as to vary the intensity of said light emitting diodes based upon the speed of the electrical motor.

17. The lighting system of claim 16, wherein said sensor comprises a Hall effect sensor.

18. The lighting system of claim 16, wherein said lighting system comprises a MOSFET switch positioned between said controller and said plurality of light emitting diodes.

19. The lighting system of claim 16, wherein said controller operates said plurality of light emitting diodes via pulse width modulation.

* * * * *